United States Patent [19]

Powell

[11] Patent Number: 4,934,269

[45] Date of Patent: Jun. 19, 1990

[54] ARMING SYSTEM FOR A WARHEAD

[76] Inventor: Roger A. Powell, 740 Jefferson Street, Red Hill, Pa. 18076

[21] Appl. No.: 280,343

[22] Filed: Dec. 6, 1988

[51] Int. Cl.[5] ..... F42C 15/40; F42C 15/00

[52] U.S. Cl. ..... 102/221; 102/215

[58] Field of Search ..... 102/206, 211, 215, 221, 102/200; 244/3.17

[56] References Cited

U.S. PATENT DOCUMENTS 4,632,031 12/1966 Jarrott et al. ..... 102/206

*Primary Examiner*—Charles T. Jordan

[57] ABSTRACT

An arming device for a warhead which determines its location on the earth using navigational satellites and compares that location with an internally stored preprogrammed location. The locations must agree before arming can be accomplished, thereby ensuring that the warhead can be armed only at its authorized location. A two-part code system that requires the first part to be entered by an operator and the second part provided by a preprogrammed storage module is also disclosed. Anti-tampering destruction features are also incorporated.

15 Claims, 2 Drawing Sheets

ARMING SYSTEM FOR A WARHEAD

BACKGROUND

This invention relates to the arming of a warhead by an electronic device. Successful completion of the arming procedure is required before the warhead may be detonated, typically by another action and/or device. A warhead on a rocket powered or aircraft delivery system poses a security risk prior to its use. For example, it may be caputured by an advancing enemy. It is therefore advantageous to have a removable pre-launch arming device that can be destroyed or carried away in the face of an advancing enemy, thereby rendering the warhead useless. Also, there is the possibility that the warhead and the arming device can be stolen and carried away by terrorists. It is therefore advantageous if the arming device will not function in the hands of the terrorists.

It is an object of this invention to provide a method for arming a warhead that requires the presence of the arming device due to the necessity to have access to its internal code. Therefore, denying access to the arming device inhibits the arming of the warhead.

Another object is to provide a method that requires the entry of a separate code into the arming device. Therefore, denying access to this code inhibits the arming of the warhead.

Another object is to provide internal means to the arming device that determines the present geographical location of the arming device and compares the present location to a preprogrammed, internally-stored location and allows successful arming only if the locations agree. Therefore, moving the arming device (and the warhead) from its preprogrammed location inhibits the arming of the warhead.

Another object is to provide an internal electronic security circuit that inhibits arming the warhead if a component of any of the circuits is disturbed. Therefore, the integrity of the arming device and/or warhead is maintained.

SUMMARY OF THE INVENTION

This invention is an arming system for a warhead. The system may incorporated a separate arming device or it may be incorporated into the warhead. As a separate device, the arming device is electrically connected to the warhead and receives a portion of the arming code from its human operator. The arming device completes the code from its internal memory and determines its global coordinates from signals from existing navigational satellites. If the arming device is at an acceptable pre-programmed global location, it will transmit the complete arming code to the warhead. There are also anti-tampering circuits in the device and in the warhead.

DESCRIPTION OF THE PREFERRED EMBODIMENT

The arming device may be used to arm a number of warheads and since it can be constructed in a small package (about the size of a suitcase), it can be easily carried away in the face of an advancing enemy or secured in a safe during peacetime.

The following description pertains to a two part code and separate arming device configuration: the first part of the code is entered by the human operator and the second part is preprogrammed into the arming device. The complete code is tranmsitted by the arming device and must be received by the warhead in order to arm it.

Figure 1:
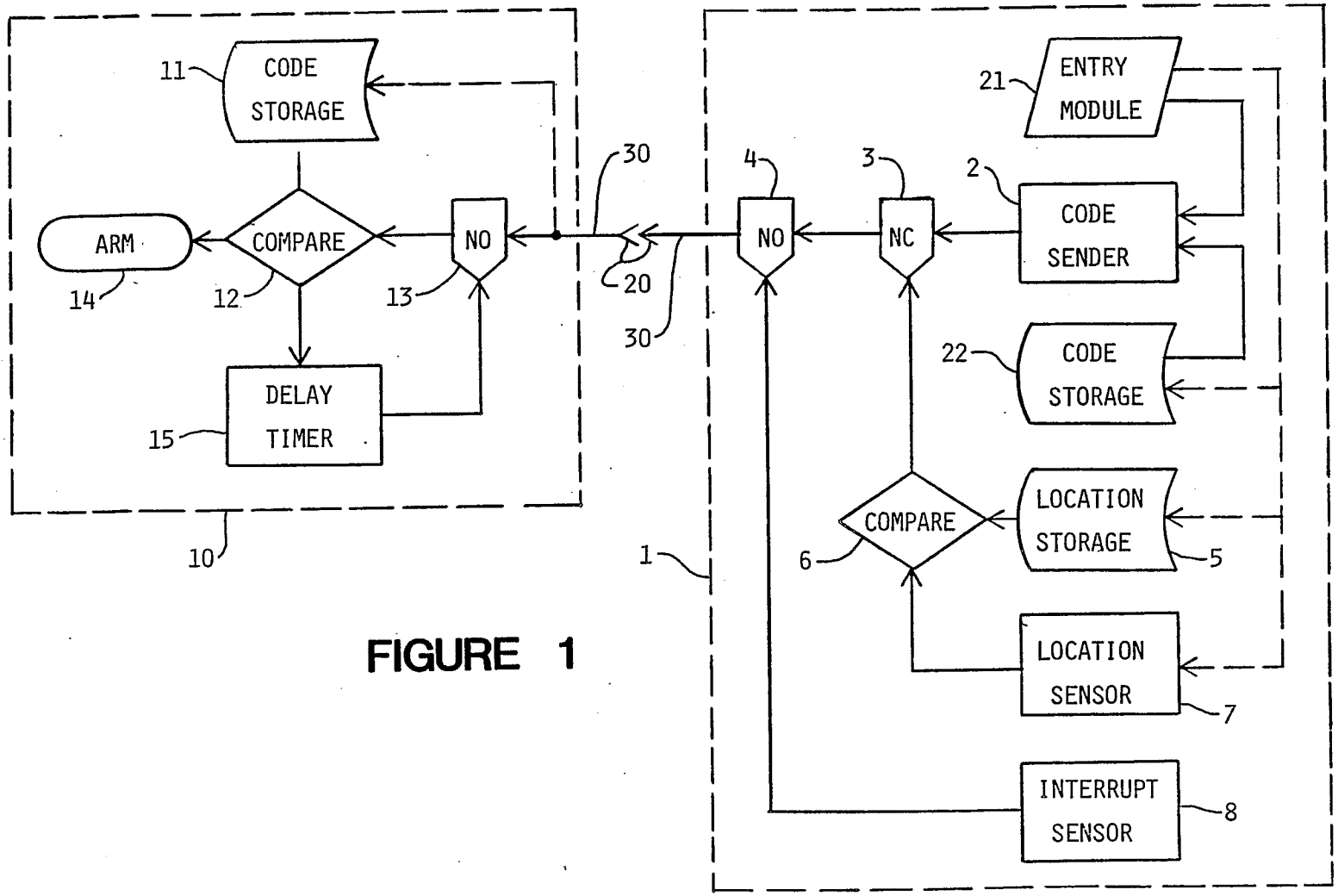
FIG. 1 shows a schematic of the preferred embodiment of the invention, having the location sensor in the arming device.

As illustrated by FIG. 1, when a warhead 10 is to be armed, the arming device 1 is connected via electrical cabling 30 and electrical connector 20 to the warhead 10. The human operator enters the arming commands and his portion of the code via an entry module 21 which may be a keyboard, a magnetic card reader, or the like.

The entry module 21 transmits a signal to the code storage module 22 to send its preprogrammed portion of the code to the code sender module 2. The entry module 21 also transmits a signal to the location sensor 7 which causes it to determine the position of the arming device on or near the surface of the earth using electronic navigational equipment that is well-known in the art. The location sensor 7, receives signals from the existing NAVY navigational satellite system (TRANSIT) using a satellite navigational receiver which is commercially available. Within several years, the Global Positioning System (GPS) also known as NAVSTAR will be fully operational to replace TRANSIT. Similarly, the location sensor could receive electromagnetic signals from this system. Other electronic navigational systems may be used to determine the position of the arming device. In some locations, LORAN-C transmitters provide electronic navigational coverage and receiving equipment is readily available to determine the geographical location of the receiver. Using the commercially available receiver and existing network, the location sensor 7 determines the longitude and latitude of its present position. The location sensor 7 transmits these coordinates to the location comparator 6. The entry module 21 also transmits a signal to the location storage module 5 which in turn transmits the preprogrammed stored coordinates of the allowable locations where the arming device may be successfully used to the location comparator 6. The location comparator 6 compares the coordinates transmitted by the location sensor 7 to the coordinates transmitted by the location storage module 5. If the coordinates agree, within a margin of error, the location comparator 6 transmits a signal that opens the normally closed (N.C.) gate 3. If the coordinates do not agree, indicating that the arming device has been moved from its intended location, the location comparator 6 leaves normally closed gate 3 in the closed state, thereby preventing transmission of the code to the warhead 10. The location comparator 6 may initiate destructive actions if the coordinates do not agree, such as destroying the pre-programmed portion of the code stored in the code storage module 22. Each of the module described is made up of suitable electronic components typically in the form of integrated circuit chips which include appropriate resistors, diodes, memory devices, etc. which are well known in the art.

The code sender module 2 transmits the total code signal which passes through the normally closed gate 3 which has been opened by location comparator 6. The code signal passes through the arming device normally open (N.O.) gate 4, through the cabling 30 and the connector 20 and into the warhead 10. The code signal then passes through the warhead normally open gate 13 to the code comparator 12. The warhead code storage module 11 sends the previously preprogrammed arming code to the code comparator 12. This may be triggered by the arrival of the input code from the arming device 1. The code comparator 12 compares the code signal sent by the arming device 1 and that from the warhead code storage module 11. If the signals agree, a signal is sent to arm the warhead 10. If the signals do not agree, a signal is sent to the count delay timer 15. The count delay timer 15 accumulates the number of times an incorrect code signal is entered into the warhead 10. After a predetermined number of incorrect code signals have been attempted, the count delay timer 15 closes the warhead normally open (N.O.) gate 13. This foils attempts to deceive the warhead by non-authorized personnel transmitting all possible codes from a simulated arming device. There are a number of other workable methods to trigger the initiation of the module functions.

In the arming device 1, a security circuit is run in series through all significant elements in the system and is powered by a small battery. If an element (such as a integrated circuit chip) is removed, the circuit is broken. This event is sensed by the interrupt sensor 8 which reacts by closing the arming device normally open (N.O.) gate 4. The gate may be resettable using another code in the entry module 21 or may be destructively closed. Such a temper-resistant method may also be used in the warhead 10. The interrupt sensor 8 may also send a command to the code storage module 22 to destroy the pre-programmed arming device portion of the code. This security circuit prevents the removal and/or replacement of circuit elements having preprogrammed codes or functions by unauthorized personnel attempting to bypass these elements to perform an unauthorized arming of the warhead.

Figure 2:
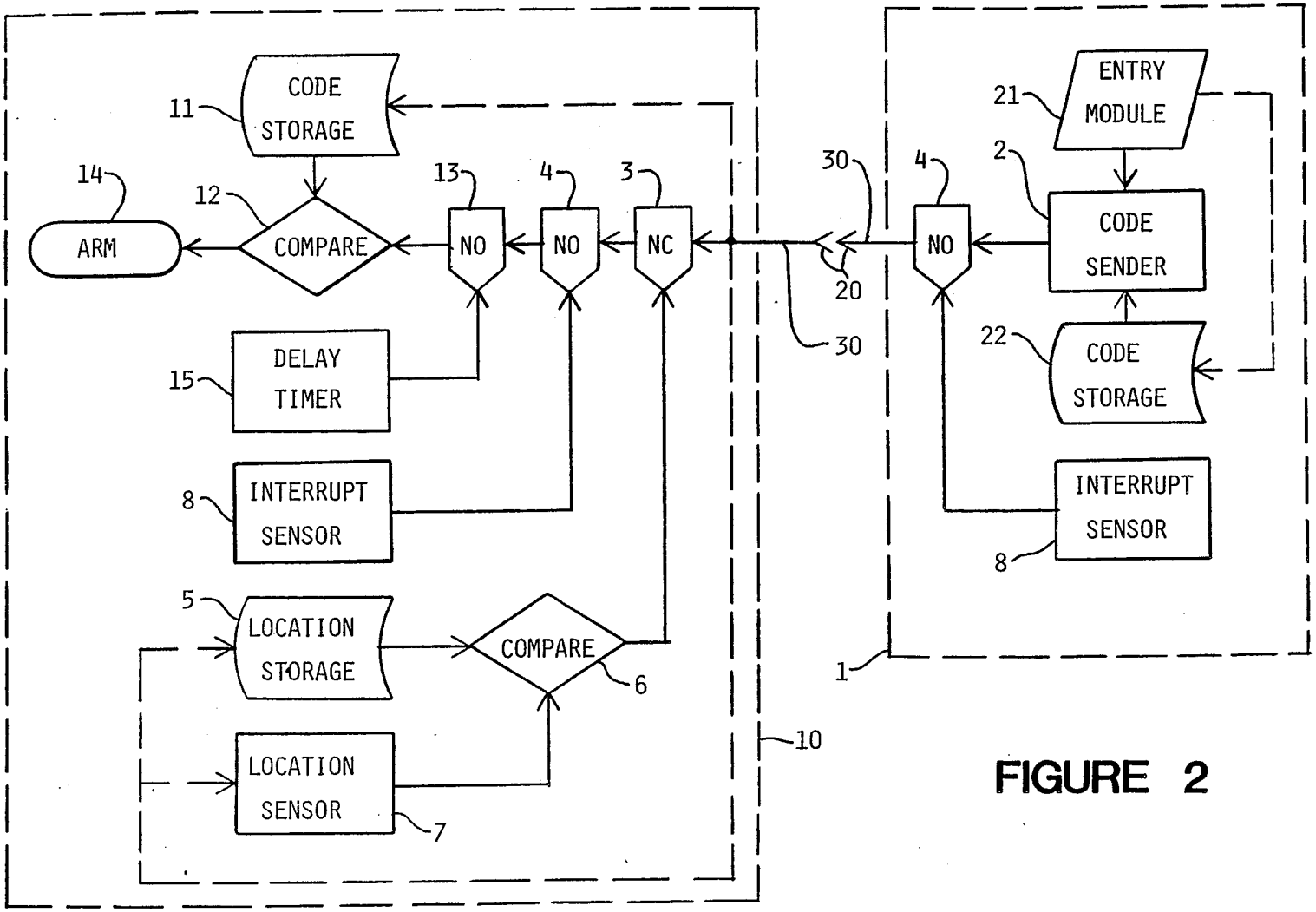
FIG. 2 shows a schematic of another embodiment of the invention, having the location sensor in the warhead.

Another emobodiment of this invention incorporates the location sensor, location storage module, and location comparator within the warhead as shown in FIG. 2. This system uses a one part code construction.

When a warhead 10 is to be armed, the arming device 1 is connected via electrical cabling 30 and electrical connector 20 to the warhead 10. The human operator enters the arming commands and his portion of the code via an entry module 21 which may be a keyboard, a magnetic card reader, or the like.

The entry module 21 transmits a signal to the code storage module 22 to send its preprogrammed portion of the code to the code sender module 2. The code sender module 2 combines the portion of the code from the entry module 21 with the portion of the code from the code storage module 22 in a pre-programmed manner and transmits the total code signal through the normally open gate 4, through the cabling 30 and the connector 20 and into the warhead 10.

The entry of the code into the warhead triggers the location sensor 7 to determine the position of the warhead 10 on or near the surface of the earth using electronic navigational equipment that is well-known in the art. The location sensor 7, receives signals from the existing navigational satellites (NAVSTAR) in the Global Positioning System (GPS) or the like and determines the longitude and latitude of its present position. The location sensor 7 transmits these coordinates to the location comparator 6. The entry of the code into the warhead also triggers the location storage module 5 which in turn transmits the stored coordinates of the allowable locations where the arming device may be successfully used to the location comparator 6. The location comparator 6 compares the coordinates transmitted by the location sensor 7 to the coordinates transmitted by the location storage module 5. If the coordinates agree, within a margin of error, the location comparator 6 transmits a signal that opens the normally closed (N.C.) gate 3. If the coordinates do not agree, indicating the warhead is not at its intended location, normally closed gate 3 remains in its closed state, stopping code transmission.

The code signal then passes through the warhead normally open (N.O.) gate 4 and normally open (N.O.) gate 13 to the code comparator 12. The warhead code storage module 11 sends the previously stored arming code to the code comparator 12. This may be triggered by the arrival of the input code from the arming device 1. The code comparator 12 compares the code signal sent by the arming device 1 and that sent from the warhead code storage module 11. If the signals agree, a signal is sent to arm the warhead 10. If the signals do not agree, a signal is sent to the count delay timer 15. The count delay timer 15 accumulates the number of times an incorrect code signal is entered into the warhead 10. After a predetermined number of incorrect code signals have been attemped, the count delay timer 15 closes the warhead normally open (N.O.) gate 13. This stops attempts to deceive the warhead by non-authorized personnel transmitting all possible codes from a simulated arming device.

This embodiment also includes a security circuit as represented by the interrupt sensor 8 and the normally open (N.O.) gate 4 in the warhead 10 and in the arming device 1 as previously described.

Another embodiment eliminates all the modules in the arming circuit shown in FIG. 2 except the entry module 21 and would use a one-part code that the operator would enter and transmit to the warhead 10.

A variation on the prior embodiments uses signal from the location comparator 6 to trigger the code sender module 2 to send the code rather than inhibiting the transmission of the code by the normally closed (N.C.) gate 3. Therefore, the code will not be transmitted if the location signals from the location sensor 7 and the location storage module 5 do not agree. Similarly, the method of triggering functions and inhibiting functions may vary without changing the overall logic of the precursor events that must occur before arming can occur.

While the invention has been particularly shown and described in reference to a preferred embodiment thereof, it will be understood by those skilled in the art that the foregoing and other changes in form and detail may be made therein without departing from the spirit and scope of the invention, and as defined by the claim appended hereto.

I claim:

1. A warhead arming device, comprising:

a first means for determining the present geographic location of the arming device;

a second means for storing a predetermined allowable geographical location at which said arming device may arm a warhead;

a third means for comparing the geographical location determined by said first means with the predetermined allowable geographical location stored by said second means, determining that the locations agree, and transmitting an arming signal to the warhead.

2. A warhead arming device as recited in claim 1, wherein said first means for determining the present location comprises means for receiving and electronically processing electromagnetic signals from external sources.

3. A warhead arming device as recited in claim 2, wherein said external sources comprise navigational satellites.

4. A warhead arming device as recited in claim 1, further comprising means for interrupting the transmission of the arming signal when a component in the arming device is removed.

5. A warhead arming device as recited in claim 4, wherein said means for interrupting the transmission of the arming signal comprises means for transmitting a test signal through a portion of each significant component of said warhead arming device and monitoring the return of said test signal.

6. A warhead arming device, said arming device being required to send a predetermined code to a warhead to cause it to be armed, comprising:

means for an operator to enter a portion of the arming code into said arming device;

means for storing the remainder of the arming code internally in said arming device;

means for combining the operator-entered portion of said required code with the internally-stored portion of said code, and transmitting the combined code.

7. A warhead arming device as recited in claim 6, further comprising means to interrupt the transission of said arming signal when a component in the arming device is removed.

8. A warhead arming device as recited in claim 7, wherein said means for interrupting the transmission of the arming signal comprises means for transmitting a test signal through a portion of each significant component of said warhead arming device and monitoring the return of said test signal.

9. A warhead arming device as recited in claim 6, further comprising means for destroying said means for storing the remainder of said arming code when a component is removed.

10. A warhead arming device as recited in claim 6, further comprising:

a first means for determining the present geographic location of said arming device;

a second means for storing a predetermined allowable geographical location at which said arming device may arm a warhead;

a third means for comparing the geographical location determined by said first means with the predetermined allowable geographical location stored by said second means, determining that the locations agree, and allowing transmission of the arming signal to the warhead.

11. A warhead comprising:

a first means for determining the present geographic location of said warhead;

a second means for storing a predetermined allowable geographical location at which said warhead may be armed;

a third means for comparing the geographical location determined by said first means with the predetermined allowable geographical location stored by said second means, determining that the locations agree, and arming the warhead.

12. A warhead as recited in clam 11, wherein said first means for determining the present location comprises means for receiving and electronically processing electromagnetic signals from external sources.

13. A warhead as recited in claim 12, wherein said external sources comprise navigational satellites.

14. A warhead as recited in claim 11, further comprising means for inhibiting the arming of said warhead when a component in the arming circuit is removed.

15. A method for arming a warhead comprising:

determining the present geographical location of said warhead by means of electronic navigation;

comparing the present geographical location of said warhead to a preprogrammed stored location; and arming said warhead when the present geographical location and the preprogrammed stored location agree.

* * * * *